US009902581B2

(12) United States Patent
Nagura

(10) Patent No.: US 9,902,581 B2
(45) Date of Patent: Feb. 27, 2018

(54) PAPER-SHEET TRANSPORT DEVICE

(71) Applicant: NEC Platforms, Ltd., Kawasaki-shi, Kanagawa (JP)

(72) Inventor: Yasukazu Nagura, Kanagawa (JP)

(73) Assignee: NEC PLATFORMS, LTD, Kanagawa (JP)

( * ) Notice: Subject to any disclaimer, the term of this patent is extended or adjusted under 35 U.S.C. 154(b) by 0 days.

(21) Appl. No.: 15/324,048

(22) PCT Filed: Jul. 29, 2015

(86) PCT No.: PCT/JP2015/003794
§ 371 (c)(1),
(2) Date: Jan. 5, 2017

(87) PCT Pub. No.: WO2016/017159
PCT Pub. Date: Feb. 4, 2016

(65) Prior Publication Data

US 2017/0203932 A1 Jul. 20, 2017

(30) Foreign Application Priority Data

Jul. 30, 2014 (JP) ..... 2014-154774

(51) Int. Cl.
*B65H 5/00* (2006.01)
*B65H 3/06* (2006.01)
*B65H 5/06* (2006.01)

(52) U.S. Cl.
CPC ..... *B65H 3/0669* (2013.01); *B65H 5/06* (2013.01); *B65H 2402/441* (2013.01);
(Continued)

(58) Field of Classification Search
CPC .. B65H 3/0669; B65H 5/06; B65H 2402/441; B65H 2402/45; B65H 2403/70; B65H 2405/115; B65H 2601/321
See application file for complete search history.

(56) References Cited

U.S. PATENT DOCUMENTS 6,578,840 B1 * 6/2003 Kudo ..... B65H 3/0669 271/10.01
7,549,627 B2 * 6/2009 Lin ..... B65H 3/0669 271/10.01

(Continued)

FOREIGN PATENT DOCUMENTS

JP 63-163951 U 10/1988
JP S63-163951 U 10/1988

(Continued)

OTHER PUBLICATIONS

Japanese Office Action for JP Application No. 2014-154774 dated Jul. 5, 2016 with English Translation.

(Continued)

*Primary Examiner* — Prasad V Gokhale

(57) ABSTRACT

To enable a user, when removing a sheet of paper from a transport mechanism, to easily remove the sheet of paper from the transport mechanism even with structure in which a transport roller is provided at a position inaccessible to a user. A paper-sheet transport device, including: a drive part which drives a transport mechanism transporting a sheet of paper; a cover; a shaft that rotatable in a predetermined direction by drive generated by the drive part, the shaft including a transport roller fixed thereto for transporting the sheet of paper; a lever which is arranged at, at least, a drive part side end out of both ends of the shaft and which, through a part of the cover, receives force due to an opening/closing operation of the cover; and a ratchet via which the lever and the shaft are engaged or disengaged, and which changes from the engaged state to the disengaged state in response to the lever receiving the force due to the opening/closing operation of the cover.

13 Claims, 7 Drawing Sheets

(52) U.S. Cl.
CPC ..... *B65H 2402/45* (2013.01); *B65H 2403/70* (2013.01); *B65H 2601/321* (2013.01)

(56) References Cited

U.S. PATENT DOCUMENTS

| | | | | |
|---|---|---|---|---|
| 7,984,907 | B2 * | 7/2011 | Chen | B65H 5/06 271/273 |
| 8,894,061 | B2 * | 11/2014 | Matsuoka | B65H 5/06 271/10.13 |
| 2006/0269350 | A1 * | 11/2006 | Koba | B41J 11/006 400/691 |
| 2008/0012200 | A1 * | 1/2008 | Lin | B65H 3/0669 271/10.13 |
| 2011/0156346 | A1 * | 6/2011 | Chen | B65H 5/06 271/264 |
| 2013/0015622 | A1 * | 1/2013 | Hata | B65H 29/125 271/272 |
| 2013/0336696 | A1 * | 12/2013 | Recinto | B65H 3/06 399/367 |
| 2015/0172491 | A1 * | 6/2015 | Lee | B65H 5/06 358/498 |
| 2017/0142265 | A1 * | 5/2017 | Horikawa | H04N 1/0057 |

FOREIGN PATENT DOCUMENTS

| | | | |
|---|---|---|---|
| JP | H10-236688 | A | 9/1998 |
| JP | 2001-348130 | A | 12/2001 |
| JP | 2006-347770 | A | 12/2006 |
| JP | 2011-213447 | A | 10/2011 |

OTHER PUBLICATIONS

International Search Report for PCT Application No. PCT/JP2015/003794, dated Oct. 6, 2015.
English translation of Written opinion for PCT Application No. PCT/JP2015/003794.
US Non-Final Office Action U.S. Appl. No. 15/324,048 dated Jul. 21, 2017.

* cited by examiner

PAPER-SHEET TRANSPORT DEVICE

This application is a National Stage Entry of PCT/JP2015/003794 filed on Jul. 29, 2015, which claims priority from Japanese Patent Application 2014-154774 filed on Jul. 30, 2014, the contents of all of which are incorporated herein by reference, in their entirety.

TECHNICAL FIELD

The present invention relates to a paper-sheet transport device which is applicable to a mechanism for transporting a sheet of paper such as a recording sheet or the like, for example, in an image processing device such as a printer or the like.

BACKGROUND ART

A sheet transport device, which is used in a printer, a facsimile, or the like and which can transport a recording sheet (hereinafter, referred to as "sheet") on which an image is printed (recorded), has been developed. For example, PTL (Patent literature) 1 discloses an art which prevents causing a trouble in transporting a sheet by stopping an edge of the sheet to adjust a position and a direction.

A main function of the above-mentioned sheet transport device is to feed the sheet one by one out of a sheaf of plural sheets to a reading unit, and to maintain a constant speed of transporting the sheet when feeding the sheet. However, some kind of errors may cause the so-called paper jam that a sheet to be transported remains inside the sheet transport device. Accordingly, in order that a user can remove the remaining sheet, it is necessary to provide the sheet transport device with structure that a part of a transport path can be opened and closed.

PTL 2 and PTL 3 disclose an art that, in the case of the paper jam, an edge of the jammed sheet is discharged to a paper discharge port by rotating a paper transport mechanism or the like.

CITATION LIST

Patent Literature

PTL 1 Japanese Patent Application Laid-Open Publication No. 2001-348130

PTL 2 Japanese Utility Model Application Laid-Open Publication No. 1988-163951

PTL 3 Japanese Patent Application Laid-Open Publication No. 2011-213447

SUMMARY OF INVENTION

Technical Problem

According to the art which is disclosed by PTL 1, in some cases, a transport mechanism may have structure that a subsidiary roller, which forms a pair with a transport roller and rotates cooperatively with the transport roller, is attached to a paper feed cover. In the case of the above-mentioned structure, a user draws a sheet from the roller pair by making the paper feed cover enter into an opened state. However, in the case of making the subsidiary roller physically separated from the transport roller in order to draw the sheet, the user has to apply considerable pressure to the subsidiary roller. Therefore, in the case that the pressure of the transport roller is not suitably released, or in the case that the transport roller is not made run at idle, the user can not draw the sheet when the user does not pull the sheet with strong force. Consequently, there is a case that the important sheet is damaged. Furthermore, in the case of structure that the subsidiary roller is provided at a position at which the paper feed cover cannot be opened and closed when accessing the transport mechanism, the user can not release the pressure, which is applied to the transport roller, in the first place.

According to the art which is disclosed by PTLs 2 and 3, there is a case that, depending on a situation of the paper jam, it is impossible to transport the sheet to the paper discharge port by rotating the paper transport mechanism or the like.

The present invention has been conceived in order to solve the above-mentioned problem. A main object of the present invention is to provide a paper-sheet transport device which enables a user, when removing a sheet of paper from a transport mechanism, to easily remove the sheet of paper from the transport mechanism even with structure in which a transport roller is provided at a position inaccessible to a user.

Solution to Problem

To solve the above problem, an aspect of the present invention is:

a paper-sheet transport device, comprising:

a drive part that drives a transport mechanism transporting a sheet of paper; a cover;

a shaft that rotatable in a predetermined direction by drive generated by the drive part, the shaft including a transport roller fixed thereto for transporting the sheet of paper;

a lever that is arranged at, at least, a drive part side end out of both ends of the shaft and which, through a part of the cover, receives force due to an opening/closing operation of the cover; and a ratchet via that the lever and the shaft are engaged or disengaged, and that changes from the engaged state to the disengaged state in response to the lever receiving the force due to the opening/closing operation of the cover.

Advantageous Effects of Invention

According to the present invention, when removing the sheet of paper from the transport mechanism, the user can easily remove the sheet of paper from the transport mechanism even with the structure in which the transport roller is provided at the position inaccessible to the user.

DESCRIPTION OF EMBODIMENTS

Next, an example embodiment of the present invention will be explained in detail with reference to drawings. An identical or similar part in each drawing, which will be shown later, has an identical or similar reference sign. However, each drawing schematically shows structure in the example embodiment of the present invention and does not limit the present invention at all. That is, the example embodiment described in the following is an example of the present invention and can be appropriately changed within the scope which has the same essence.

First Example Embodiment

Figure 1:
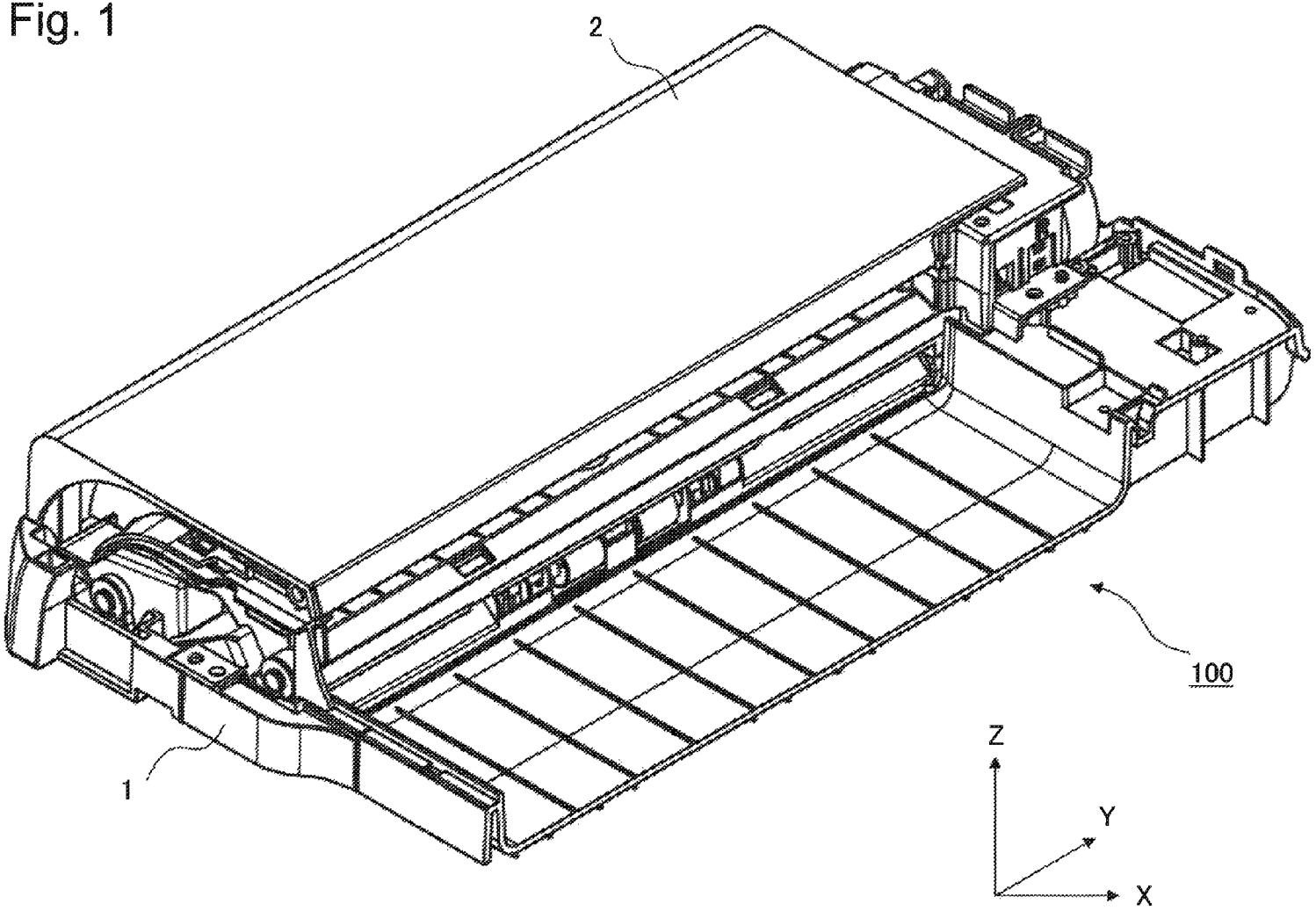
FIG. 1 is an external view of a paper-sheet transport device according to a first example embodiment of the present invention.
Figure 2:
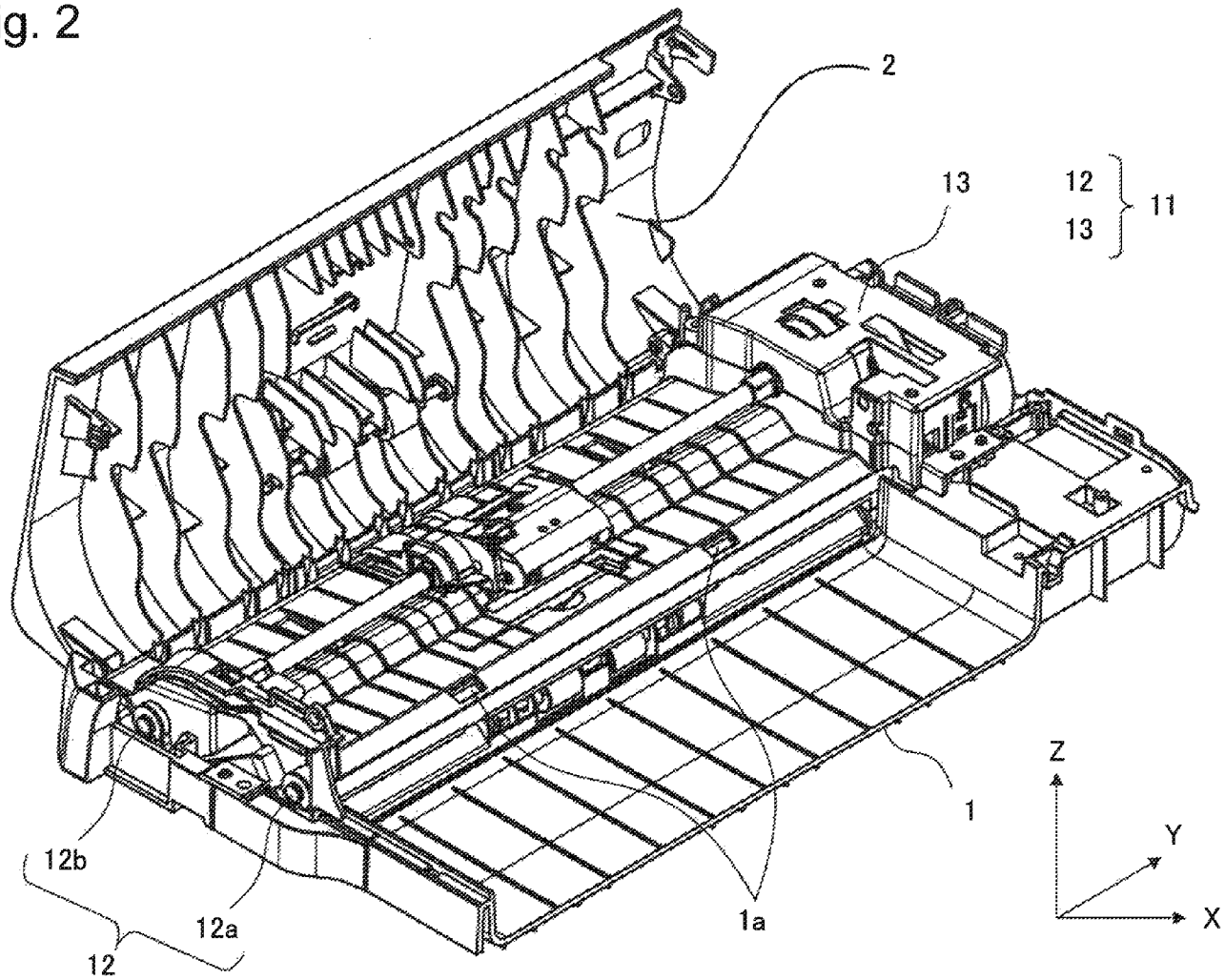
FIG. 2 is a diagram showing internal structure of the paper-sheet transport device according to the first example embodiment whose cover part is opened.

FIG. 1 is an external view (perspective view) of a paper-sheet transport device 100 according to a first example embodiment of the present invention. FIG. 2 is a diagram showing internal structure of the paper-sheet transport device 100 according to the first example embodiment whose cover part 2 is opened. Structure, in which the paper-sheet transport device 100 according to the example embodiment is mounted on a printer, will be explained in the following as an example. That is, the present invention is not limited to the above-mentioned structure and is applicable to various devices which transport a sheet of paper.

The paper-sheet transport device 100 according to the first example embodiment includes a paper-sheet transport part 1 and the cover part 2 as shown in FIG. 1.

The paper-sheet transport part 1 is a mechanism which, when transporting various sheets (sheets of paper) to a print mechanism (not shown in the drawing), can transport each sheet of paper in a predetermined direction at a constant interval. Since the general art can be applied to the structure for transporting the sheet of paper, detailed explanation on the structure is omitted in the example embodiment.

The cover part 2 has a function to cover the paper-sheet transport part 1 as shown in FIG. 1 and has open-able and closable structure so as to expose the most portion of the paper-sheet transport part 1 to the outside as shown in FIG. 2. It is assumed that, in order to realize the open-able and closable structure, the cover part 2 is fixed by a hinge (not shown in the drawing) or the like so as to be able to be rotated on a rotation axis, which is a part (a side) of plural surfaces forming an external shape, in order to make the paper-sheet transport part 1 enter into an exposed state from a covered state (FIG. 1). That is, in a normal usage state, the cover part 2 is in a state that the cover part 2 is arranged above the paper-sheet transport part 1 so as to cover the paper-sheet transport part 1 as shown in FIG. 1 (that is, state that the cover part 2 is closed (closed state)). In the case that it is necessary to draw a sheet from the paper-sheet transport part 1 because of, for example, an accident which is caused during a print processing, a user can open the cover part 2 upward as shown in FIG. 2.

Hereinafter, for the sake of convenience, it is assumed that the paper-sheet transport device 100 exists in the three-dimensional coordinate space (X-Y-Z coordinates) shown in FIGS. 1 and 2 and the like, and then explanation will be continued under the assumption.

Figure 3:
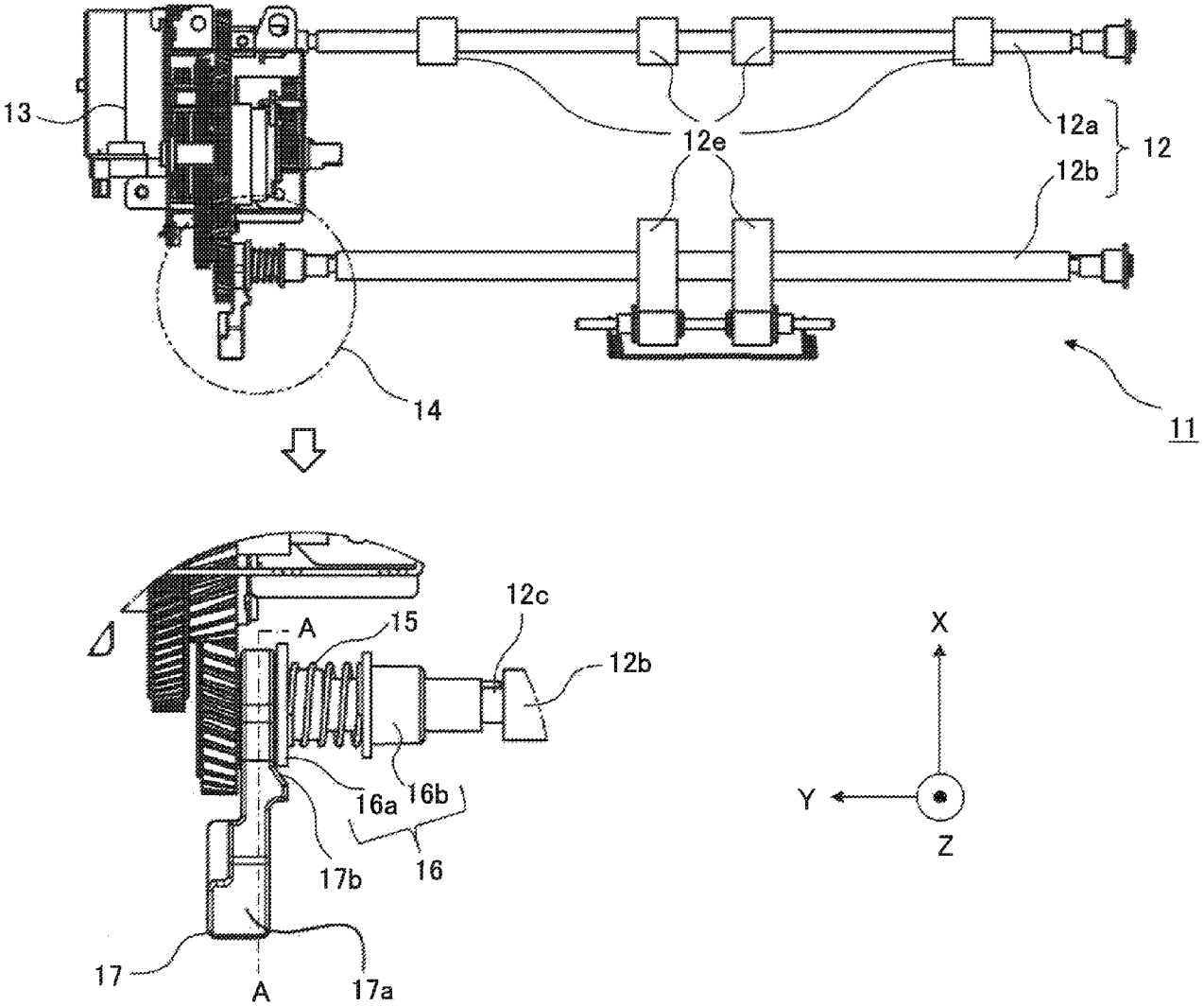
FIG. 3 is a diagram showing whole structure of a transport drive part according to the first example embodiment, and showing enlarged structure of a main part of the transport drive part.

FIG. 3 is a diagram showing whole structure of a transport driving part 11 according to the first example embodiment and showing enlarged structure of a main part of the transport driving part 11 (lower-left of FIG. 3). As shown in FIGS. 2 and 3, the paper-sheet transport part 1 includes the transport driving part 11 to transport the sheet in a transport direction. The transport driving part 11 includes a shaft 12 (12*a* and 12*b*) and a drive part 13.

The drive part 13 includes a drive source, which generates drive force, such as a motor (not shown in the drawing) or the like, and a plurality of gears which are structured so as to rotate the shaft 12.

The shaft 12 is provided along the Y axis in a direction parallel or almost parallel to the Y axis, and one end of the shaft 12 is fixed to the drive part 13. In the present example embodiment, the shaft 12 includes the shaft 12*a* which is visible from the outside when the cover 2 is in the opened state (in FIG. 2, a window 1*a* through which the shaft 12*a* is visible is arranged within a protection cover), and the shaft 12*b* which is invisible and inaccessible to the user even in the state that the cover part 2 is opened. In the example embodiment, the shaft 12*a* and shaft 12*b* may be denoted collectively as the shaft 12 in some cases.

The shaft 12 includes a transport roller 12*e*, which transports the sheet, at a predetermined position. The transport roller 12*e* is columnar or almost columnar roller which is made of the general material with elasticity such as the rubber or the like. The shaft 12 transmits drive (rotation) force, which is generated by the drive part 13, to the transport roller 12*e*. Thereby, the transport roller 12*e* is rotated in a predetermined direction, for example, in a state of forming a pair with a transport roller (not shown in the drawing) within the paper-sheet transport part 1, and consequently transports the sheet, which is put on a transport path, in a predetermined direction. Hereinafter, the pair including the transport rollers 12*e* is denoted as "transport roller pair".

A lower side of FIG. 3 shows an enlarged view of a pressure change part 14. As shown in the enlarged view, the shaft 12*b* partially includes a slender shaft 12*c* in a longitudinal direction of the shaft 12*b*. The shaft 12*b* and the slender shaft 12*c* may have structure that a through-bore is arranged in the shaft 12*b* in the longitudinal direction of the shaft 12*b*, and the slender shaft 12*c* penetrates the through-bore and is fixed by the press fit or the like. Or, the shaft 12*b* and the slender shaft 12*c* may have structure that a stopper hole (concave part), which has a shorter diameter than the shaft 12*b* has and which has a predetermined depth, is arranged in a section of the shaft 12*b*, and the slender shaft 12*c* is fixed to the shaft 12*b* by carrying out the press-fit of a part of the slender shaft 12*c* into the stopper hole. Or, the above-mentioned structure of the shaft 12*b* and the slender shaft 12*c* may be realized through a lathe's cutting a circumference of a part of the shaft 12*b* in the longitudinal direction depending on the material of the shaft 12*b*.

When the cover part 2 is in the closed state, the visible shaft 12*a* comes into contact with the transport roller 12*e*. In this case, it is possible to apply pressure to the sheet, which comes into contact with the transport roller 12*e* arranged on the shaft 12*a*, due to weight of the cover part 2 or the like. On the other hand, by making the cover part 2 enter into the opened state, the visible shaft 12*a* removes the weight of the cover part 2 or the like, and pressure is applied to the shaft 12*a* on manual so as to generate a gap between the transport roller 12*e* pair. Thereby, the pressure is removed from the sheet which comes into contact with the transport roller 12*e* arranged on the shaft 12*a*.

The invisible shaft 12*b* includes a pressure change part 14 which is arranged at one end of the invisible shaft 12*b* on the drive part 13 side and which is shown in FIG. 3 as an enlarged view of main part.

Figure 4A:
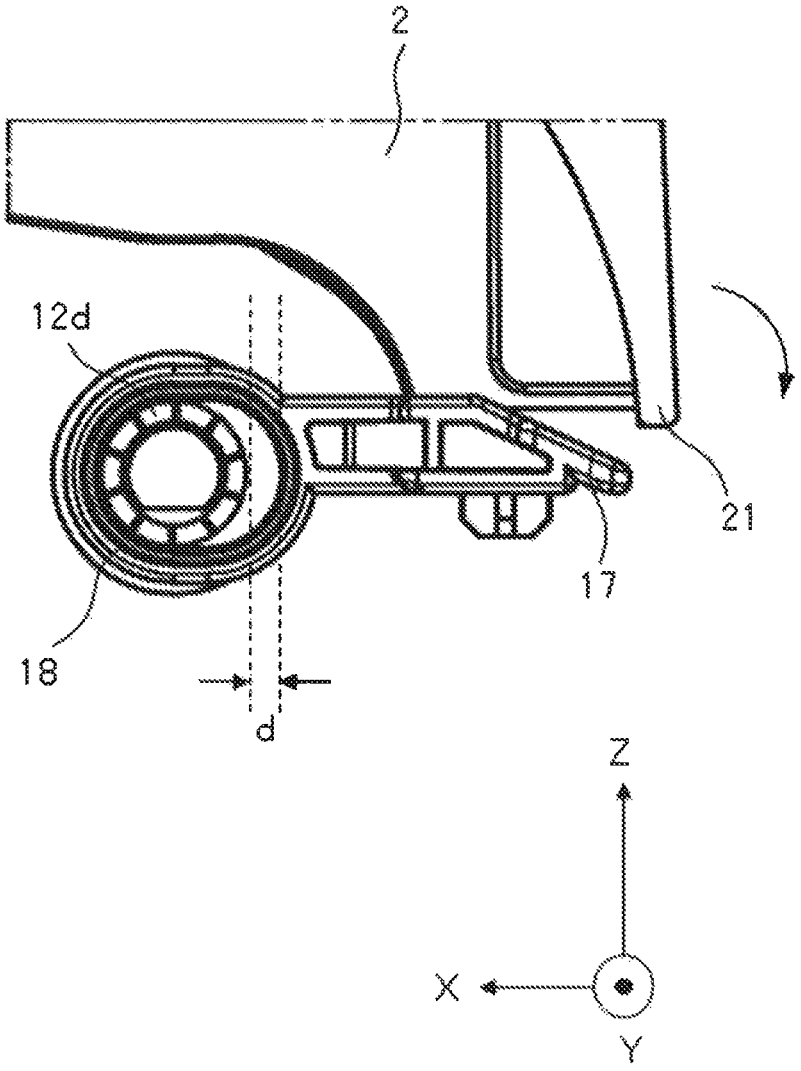
FIG. 4A is a diagram showing structure of an engagement part which engages the cover part and a paper-sheet transport part of the paper-sheet transport device according to the first example embodiment.
Figure 4B:
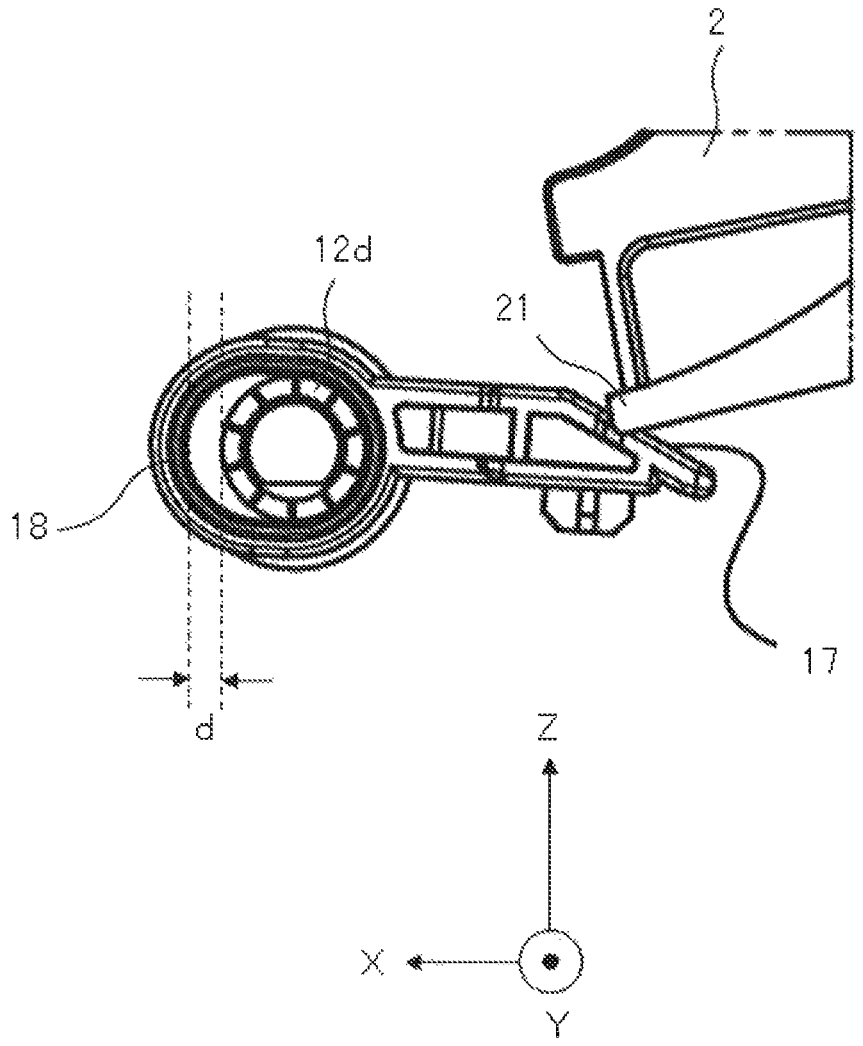
FIG. 4B is a diagram showing structure of the engagement part which engages the cover part and the paper-sheet transport part of the paper-sheet transport device according to the first example embodiment.
Figure 5A:
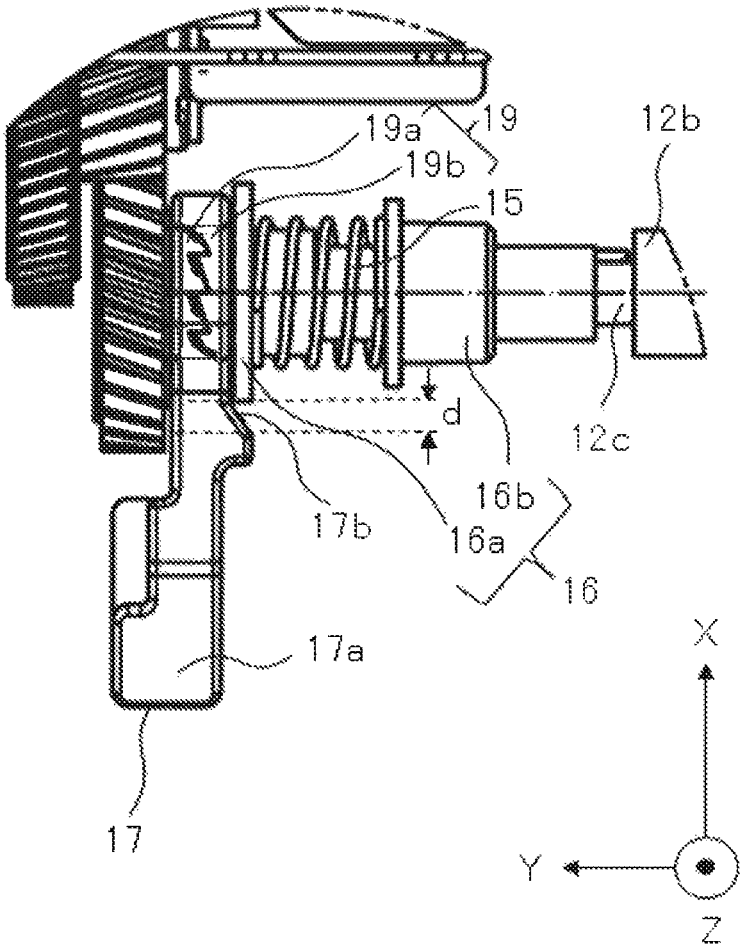
FIG. 5A is a diagram showing internal structure of a pressure change part of the paper-sheet transport device according to the first example embodiment.
Figure 5B:
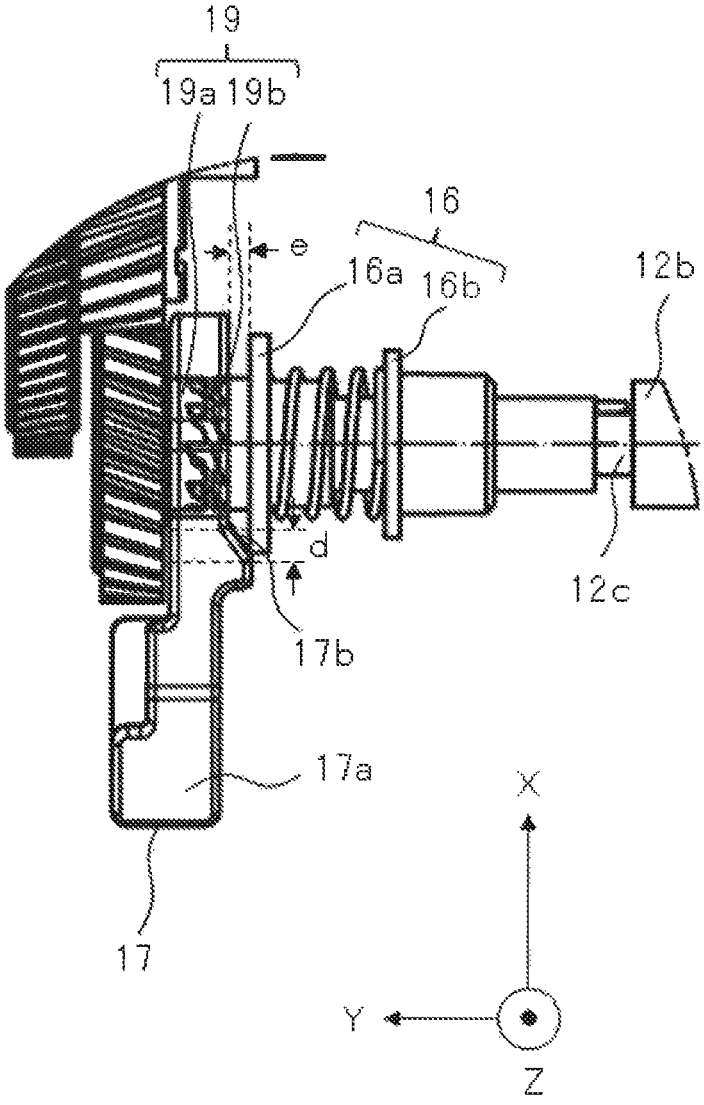
FIG. 5B is a diagram showing internal structure of the pressure change part of the paper-sheet transport device according to the first example embodiment.

Each of FIGS. 4A and 4B is a diagram showing structure of an engagement part which engages the cover part 2 and the paper-sheet transport part 1 of the paper-sheet transport device 100 according to the first example embodiment. That is, each of FIGS. 4A and 4B shows structure in a cross section view taken along a dash-and-dot line A-A drawn in the enlarged view of main part (pressure change part 14) of FIG. 3 (for the sake of convenience in explanation, each of FIGS. 4A and 4B includes a part which is not included by the A-A cross section view). FIG. 5A is a diagram showing internal structure of the main part (pressure change part 14), which is shown in the enlarged view of main part, at a time when the engagement part is in the state shown in FIG. 4A, and FIG. 5B is a diagram showing internal structure of the main part (pressure change part 14), which is shown in the enlarged view of main part, at a time when the engagement part is in the state shown in FIG. 4B As shown in FIG. 3, the pressure change part 14 is arranged on a drive part 13 side end of the shaft 12*b*. The pressure change part 14 includes a coil (coil spring) 15, a fringe 16 and a lever 17 as a roughly classified component.

The coil 15 is a spring or the like which is wound in a shape of coil, and has predetermined elasticity.

The fringe 16 includes a fringe 16*a* arranged on a drive part 13 side (hereinafter, denoted as "first fringe"), and a fringe 16*b* on a side opposite to the drive part 13 (hereinafter, denoted as "second fringe"). The first fringe 16*a* and the second fringe 16*b* are arranged so that the coil 15 may be interposed between the first fringe 16*a* and the second fringe 16*b*, and the slender shaft 12*c* of the shaft 12*b* penetrates a central part of the first fringe 16*a* and the second fringe 16*b*.

The first fringe 16*a* is arranged on the drive part 13 side. The first fringe 16*a* is a brim part which comes into contact with one end of the coil 15, and is pushed against the lever 17 by elastic force of the coil 15, and whose diameter is longer than a diameter of the coil.

The second fringe 16*b* is a brim part which is fixed to the slender shaft 12*c* of the shaft 12*b*, and is arranged at the other end of the coil 15. A diameter of the second fringe 16*b* is longer than the diameter of the coil.

The lever 17 includes a ring part containing a shaft-bearing part 18 which one end of the slender shaft 12*c* penetrates, a pressure receive part 17*a* and a slope 17*b*. The pressure receive part 17*a* receives force (stress) according to opening and closing the cover part 2, and consequently can have a posture shown in FIGS. 4A and 5A and a posture shown in FIGS. 4B and 5B. The slope 17*b* has an angle which can make insertion into the first fringe 16*a* smooth. A relation between the lever 17 and the cover part 2 will be explained in the following with reference to FIG. 4A, FIG. 4B, FIG. 5A and FIG. 5B.

The cover part 2 in FIG. 4A and FIG. 4B is fixed by the hinge (not shown in the drawing) or the like so as to be able to be rotated on the rotation axis, which is a part (a side) of plural surfaces forming the external shape, in order to make the paper-sheet transport part 1 change from the covered state (FIG. 1) to an exposed state. FIG. 4A shows fixation structure (hinge is not shown in the drawing) in which the paper-sheet transport part 1 and the cover part 2 are fixed each other in the closed state. FIG. 4B shows fixation structure (hinge is not shown in the drawing) in which the paper-sheet transport part 1 and the cover part 2 are fixed each other in the opened state. In addition to the above-mentioned fixation structure, a convex part 21 is arranged at, at least, one end (convex part 21 may be arranged at both ends) of one side, which is near to the lever 17 and is parallel or almost parallel to the Y axis, out of the plural surfaces, as shown in FIG. 4A and FIG. 4B. When the cover part 2 is in the closed state, the convex part 21 projects in a negative direction of the Z axis. Moreover, the convex part 21 rotates clockwise according to a change of the cover 2 from the closed state to the opened state, and pushes the pressure receive part 17*a* of the lever 17 with sliding on the pressure receive part 17*a*. Thereby, the lever 17 can have the posture shown in FIGS. 4A and 5A and the posture shown in FIGS. 4B and 5B.

A shaft end 12*d* is arranged, for example, at both ends of the shaft 12*b* (or, slender shaft 12*c*), and includes a ratchet mechanism inside (detail will be mentioned later). The shaft end 12*d* is inserted into the shaft-bearing part (holder) 18 which is engaged with the lever 17. The shaft-bearing part 18 has an elliptical hole (for example, an opening). In the state that the cover part 2 is closed, the shaft end 12*d* is arranged at a position which generates a space interval having a predetermined length d in the hole part in one direction (right direction in the case of FIG. 4A).

A longitudinal (Z axis direction) length of the elliptical hole of the shaft-bearing part 18 is designed to be slightly shorter than a diameter of the shaft end 12*d* and is designed so that the shaft end 12*d* does not project from the shaft-bearing part 18. Here, the lever 17 does not come into contact with the convex part 21 of the cover part 2 in the case of the closed state (FIG. 4A).

On the other hand, in the state that the cover part 2 is opened (FIG. 4B), the shaft end 12*d* is arranged at a position which generates a space interval having the predetermined length d in the hole part in the other direction (left direction in the case of FIG. 4B). That is, according to the cover part 2 being opened, the convex part 21 of the cover part 2 comes into contact with the pressure receive part 17*a* of the lever 17 to gradually press the pressure receive part 17*a* as shown in FIG. 4B. By carrying out the operation, the shaft-bearing part 18, which is engaged with the lever 17, slides (moves) in a direction almost equal to the X axis. As a result, in the state that the cover part 2 is completely opened, the space interval having the predetermined length d is generated at the left end of the shaft-bearing part 18.

Next, a state change of the pressure change part 14 according to the change of the cover part 2 from the closed state to the opened state will be explained with reference to FIGS. 5A and 5B.

The shaft end 12*d*, which is inserted into the shaft-bearing part 18 engaged with the lever 17, includes a ratchet 19. The ratchet 19 includes a pawl 19*a* and a gear 19*b* which have shapes able to engage each other. Each of the pawl 19*a* and the gear 19*b*, which are arranged oppositely and are engaged each other, has a shape (structure) that a plurality of vertical surfaces and a plurality of inclined surfaces are arranged alternately in a circumferential direction. In the engaged shape (structure), when rotating in a drive transmission direction which is a predetermined direction to transport the sheet, the vertical surfaces of the pawl 19*a* and the gear 19*b* come into contact each other in order to maintain the engaged state. On the other hand, when rotating in an opposite direction, the inclined surfaces of the pawl 19*a* and the gear 19*b* come into contact each other and slide so that the pawl 19*a* and the gear 19*b* may not be engaged each other. Then, the gear 19*b* climbs over the pawl 19*a* to run at idle.

As shown in FIG. 5A, in the state that the cover part 2 is closed, the pawl 19*a* and the gear 19*b* are engaged and coupled each other, and a predetermined load is applied to the pawl 19*a* and the gear 19*b* by elastic force of the coil 15. The elastic force is engagement force of the ratchet mechanism.

In the case that the cover part 2 is in the opened state, the pressure receive part 17*a* of the lever 17 is pressed by the convex part 21 of the cover part 2, and the space interval having the predetermined length d is generated at a left end of the shaft-bearing part 18. The length d is equal to a sliding distance d of the slope 17*b* of the lever 17 from a position of the slope 17*b* shown in FIG. 5A up to a position of the slope 17*b* shown in FIG. 5B. As a result, as shown in FIG. 5B, a predetermined interval e is generated between the pawl 19*a* and the gear 19*b* of the ratchet 19. The engagement of the pawl 19*a* and the gear 19*b* is lost by the predetermined interval e, and the gear 19*b* climbs over the pawl 19*a* to run at idle. That is, in the case that the cover part 2 is in the closed state, the elastic force of the coil 15 is applied to rotation of the shaft 12*b*, and in the case that the cover part 2 is in the opened state, repulsive force which is generated by the elastic force of the coil 15 applied to rotation of the shaft 12*b* is lost.

When the cover part 2 is opened and consequently the lever 17 is pushed by the convex part 21 to disengage the ratchet 19, a relation of force magnitude at the time is that (force to maintain the opened state of the cover part 2)> (force to engage the ratchet). Therefore, when the cover part 2 is opened, even if an operator takes his hand off, the disengaged state of the ratchet 19 is maintained. Moreover, when the cover part 2 is closed, the lever 17 is pushed back by the engagement force of the ratchet 19, and also the ratchet 19 returns to the engaged state. When the engagement force of the ratchet 19 does not strongly work on the force to push back the lever 17, the lever 17 does not return. However, in the above-mentioned state, if drive transmission is generated by the drive part 13, the drive transmission strongly works as the force to push back the lever 17 so as to supplement the engagement force of the ratchet. As a result, it is surely guaranteed that the lever 17 is returned at a time of the drive transmission. That is, the engagement force of the ratchet 19 is weaker than pressure with which the transport roller 12*e* transports the sheet. As a result, it is possible to draw the sheet from the paper-sheet transport part 1 with weak force, and it is possible to prevent the sheet from being damaged when the user draws the sheet.

Here, since the elastic force of the coil 15 may be not so strong in comparison with the pressure of the transport roller 12*e*, force to draw the sheet in one direction (for example, direction to sheet discharge port) may be relatively weak even when the cover part 2 is in the closed state.

According to the first example embodiment mentioned above, when the user wants to remove the sheet (sheet of paper) from the transport mechanism since the paper jam is caused, the user can easily remove the sheet from the transport mechanism even with the structure in which the shaft 12*b* including the transport roller 12*e* is provided at the position inaccessible to the user. The reason is that, when removing the sheet, the lever 17, which works cooperatively with the cover part 2, disengages the ratchet 19 to make the shaft 12*a*, to which the transport roller 12*e* is fixed, run at idle, and consequently it is possible to release the pressure with a light load.

The above-mentioned paper-sheet transport device 100 according to the first example embodiment can be grasped as the following explanation.

That is, the paper-sheet transport device 100 includes a drive part (11), a cover (2), a shaft (12*a*), a lever (17) and a ratchet (19).

The drive part (11) includes a transport mechanism for transporting the sheet of paper.

The cover (2) is fixed near to the drive part (11) so as to be able to be rotated.

The shaft (12*a*), to which a transport roller (12*e*) for transporting the sheet of paper that is a transport target is fixed, can be rotated in a predetermined direction by drive force of the drive part (11).

The lever (17) is arranged at, at least, a drive part (11) side end out of both ends of the shaft (12*a*), and receives force due to the opening/closing operation of the cover through a part of cover (2).

The ratchet (19) can engage and disengage the lever (17) and the shaft (12*a*).

In the paper-sheet transport device 100, the ratchet (19) changes from the engaged state to the disengaged state in response to the lever (17) receiving the force due to the opening/closing operation of the cover (2), and consequently the transport roller (12*e*), which is fixed to the shaft (12*a*), enters into a state that the transport roller (12*e*) can rotate also in the direction opposite to the predetermined direction.

Thereby, when removing the sheet of paper from the transport mechanism, the user can easily remove the sheet of paper from the transport mechanism even with structure in which the transport roller is provided at the position inaccessible to the user.

Hereinbefore, the present invention has been explained with using the above-mentioned example embodiment as an exemplary example. However, the present invention is not limited to the above-mentioned example embodiment. That is, various aspects, which a person skilled in the art can understand, are applicable to the present invention within the scope of the present invention.

This application is based upon and claims the benefit of priority from Japanese Patent Application No. 2014-154774, filed on Jul. 30, 2014, the disclosure of which is incorporated herein in its entirety by reference.

REFERENCE SIGNS LIST

1 paper-sheet transport part
2 cover part
11 transport drive part
12 shaft
12*a* shaft
12*b* shaft
12*c* slender shaft part
12*d* shaft end
12*e* transport roller
13 drive part
14 pressure change part
15 coil
16 fringe
16*a* first fringe
16*b* second fringe
17 lever
17*a* pressure receive part
17*b* slope

18 shaft-bearing part
19 ratchet
19*a* pawl
19*b* gear
21 convex part

The invention claimed is:

1. A paper-sheet transport device, comprising:

a drive part that drives a transport mechanism transporting a sheet of paper;

a cover;

a shaft to which a transport roller for transporting the sheet of paper is fixed and which can be rotated in a predetermined direction by the drive part;

a lever that is arranged at, at least at a drive part side end out of both ends of the shaft and which, via a part of the cover, receives a force due to an opening-and-closing operation of the cover; and a ratchet that is capable of engaging and disengaging between the shaft and the driving part in the vicinity of a bearing part of the shaft, wherein the bearing part of the shaft is integrally formed with the lever, wherein the ratchet changes from an engaged state to a disengaged state in response to the lever receiving the force due to the opening-and-closing operation of the cover, and the transport roller fixed to the shaft rotates in the predetermined direction and in the opposite direction thereof.

2. The paper-sheet transport device according to claim 1, wherein the ratchet is arranged between the shaft and the drive part.

3. The paper-sheet transport device according to claim 2, wherein the lever is engaged with a shaft-bearing part which can slide in a direction and in an opposite direction, and the ratchet is changed from the engaged state to the disengaged state by the shaft-bearing part sliding in response to the lever receiving the force.

4. The paper-sheet transport device according claim 2, wherein the force which the lever receives in the disengaged state is stronger than the force which makes the ratchet enter into the engaged state.

5. The paper-sheet transport device according claim 2, wherein the shaft comprises a pair of fringes, and an elastic member interposed between the pair of fringes, and wherein the lever has a shape of a slope which has an angle for acting on a fringe of the pair of fringes.

6. The paper-sheet transport device according to claim 1, wherein the lever is engaged with a shaft-bearing part that is slidable in one direction and a direction opposite thereto, and the ratchet is changed from the engaged state to the disengaged state by the shaft-bearing part sliding in response to the lever receiving the force.

7. The paper-sheet transport device according claim 6, wherein the force which the lever receives in the disengaged state is stronger than the force which makes the ratchet enter into the engaged state.

8. The paper-sheet transport device according claim 6, wherein the shaft comprises a pair of fringes, and an elastic member interposed between the pair of fringes, and wherein the lever has a shape of a slope, the slope having an angle for acting on a fringe of the pair of fringes.

9. The paper-sheet transport device according claim 1, wherein the force which the lever receives in the disengaged state is stronger than the force which makes the ratchet enter into the engaged state.

10. The paper-sheet transport device according claim 9, wherein the shaft comprises a pair of fringes and an elastic member interposed between the pair of fringes, and wherein the lever has a shape of a slope, the slope having an angle for acting on a fringe of the pair of fringes.

11. The paper-sheet transport device according claim 1, wherein the shaft comprises a pair of fringes and an elastic member interposed between the pair of fringes, and wherein the lever has a shape of a slope, the slope having an angle for acting on a fringe of the pair of fringes.

12. The paper-sheet transport device according claim 11, wherein a force which engages the pair of fringes is an elastic force supplied by the elastic member.

13. The paper-sheet transport device according claim 1, the paper-sheet transport device further comprising: a plurality of gears for transmitting power of the driving part, wherein the shaft is installed on the outermost gear of the plurality of gears.

* * * * *